US008570268B2

(12) United States Patent
Sheu et al.

(10) Patent No.: US 8,570,268 B2
(45) Date of Patent: Oct. 29, 2013

(54) DRIVING METHOD OF LIQUID CRYSTAL DISPLAY

(75) Inventors: Yi-Zhong Sheu, Miao-Li County (TW); Jui-Feng Ko, Miao-Li County (TW)

(73) Assignee: Chimei Innolux Corporation, Miaoli County (TW)

( * ) Notice: Subject to any disclaimer, the term of this patent is extended or adjusted under 35 U.S.C. 154(b) by 700 days.

(21) Appl. No.: 12/720,643

(22) Filed: Mar. 9, 2010

(65) Prior Publication Data

US 2011/0057915 A1 Mar. 10, 2011

(30) Foreign Application Priority Data

Sep. 8, 2009 (CN) ..... 2009 1 0306704

(51) Int. Cl.
*G09G 3/36* (2006.01)

(52) U.S. Cl.
USPC ..... 345/100; 345/204; 377/64

(58) Field of Classification Search
USPC ..... 345/87, 90, 94, 95, 98, 99, 100, 345/204–206, 690; 377/64–81
See application file for complete search history.

(56) References Cited

U.S. PATENT DOCUMENTS

| | | | | |
|---|---|---|---|---|
| 5,606,342 | A * | 2/1997 | Shoji et al. | 345/94 |
| 5,670,973 | A * | 9/1997 | Bassetti et al. | 345/58 |
| 6,222,516 | B1 * | 4/2001 | Oda et al. | 345/94 |
| 7,616,181 | B2 * | 11/2009 | Kuo et al. | 345/98 |
| 7,973,749 | B2 * | 7/2011 | Uehara et al. | 345/87 |
| 8,274,467 | B2 * | 9/2012 | Qi et al. | 345/99 |
| 2003/0117353 | A1 * | 6/2003 | Moon | 345/87 |
| 2007/0120801 | A1 * | 5/2007 | Ho et al. | 345/98 |
| 2007/0152947 | A1 * | 7/2007 | Tanaka et al. | 345/100 |
| 2008/0129722 | A1 * | 6/2008 | Qi et al. | 345/212 |
| 2008/0239184 | A1 * | 10/2008 | Kim et al. | 349/41 |
| 2009/0058788 | A1 * | 3/2009 | Ha et al. | 345/99 |
| 2009/0096771 | A1 * | 4/2009 | Lee | 345/204 |

* cited by examiner

*Primary Examiner* — Tom Sheng
(74) *Attorney, Agent, or Firm* — Muncy, Geissler, Olds & Lowe, PLLC

(57) ABSTRACT

A liquid crystal display comprising a display region, a control unit, a plurality of source drivers located along a first direction, and a plurality of gate drivers located along a second direction orthogonal to the first direction. A driving method of the liquid crystal display comprises dividing the display region into a plurality of screen regions with each screen region is in correspondence with one source driver or one gate driver; according to the display characteristics of the screen regions. The control unit generates a plurality of regulated signals for changing the output voltage value of the corresponding driver or changing the operating time of the corresponding driver. The regulated signal are sent to the corresponding driver.

4 Claims, 10 Drawing Sheets

DRIVING METHOD OF LIQUID CRYSTAL DISPLAY

BACKGROUND

1. Technical Field

The present disclosure relates to a driving method of liquid crystal display (LCD) for improving display quality.

2. Description of Related Art

An LCD includes a plurality of scan lines and data lines, and an array of pixels arranged between adjacent scanning lines and data lines. Bigger sizes LCDs require longer scanning lines and data lines, which increases line resistance. The signals are transmitted through the scanning lines and data lines.

Referring to FIG. 9, when the scan signals are transmitting through the scan lines, the farther the transmission distance, the more serious delay of the scan signals. There is an offset between the scan signals and the data signals. Therefore, the time allocated for charging the pixels is inadequate.

Likewise, referring to FIG. 10, when the data signals are transmitting through the data lines, the farther the transmission distance, the more serious delay of the data signals. There is an offset between the data signals and the scan signals. Therefore, the time allocated for charging the pixels is inadequate.

Because of these delays in signal, the brightness of the LCD is nonuniform, and the quality of image displayed by the LCD may be substandard.

Therefore, it is desired to provide a driving method of LCD which can overcome the above-described deficiencies.

BRIEF DESCRIPTION OF THE DRAWINGS

Many aspects of the present driving method of LCD can be better understood with reference to the following drawings. The components in the various drawings are not necessarily drawn to scale, the emphasis instead being placed upon clearly illustrating the principles of the present driving method of LCD.

DETAILED DESCRIPTION

Reference is now made to the drawings to describe various embodiments of the present disclosure in detail.

Figure 1:
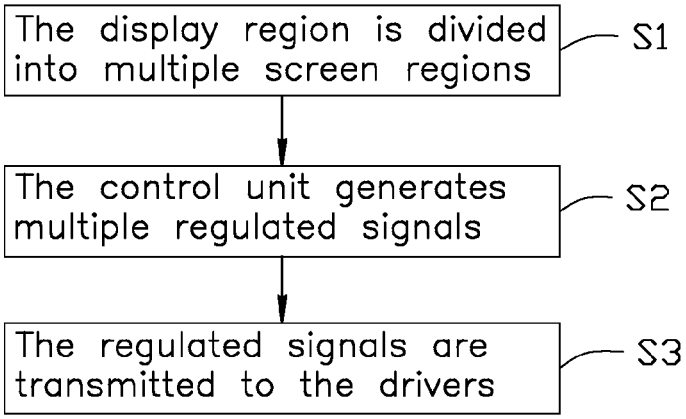
FIG. 1 is a flow chart of a driving method of LCD, according to the present disclosure.
Figure 2:
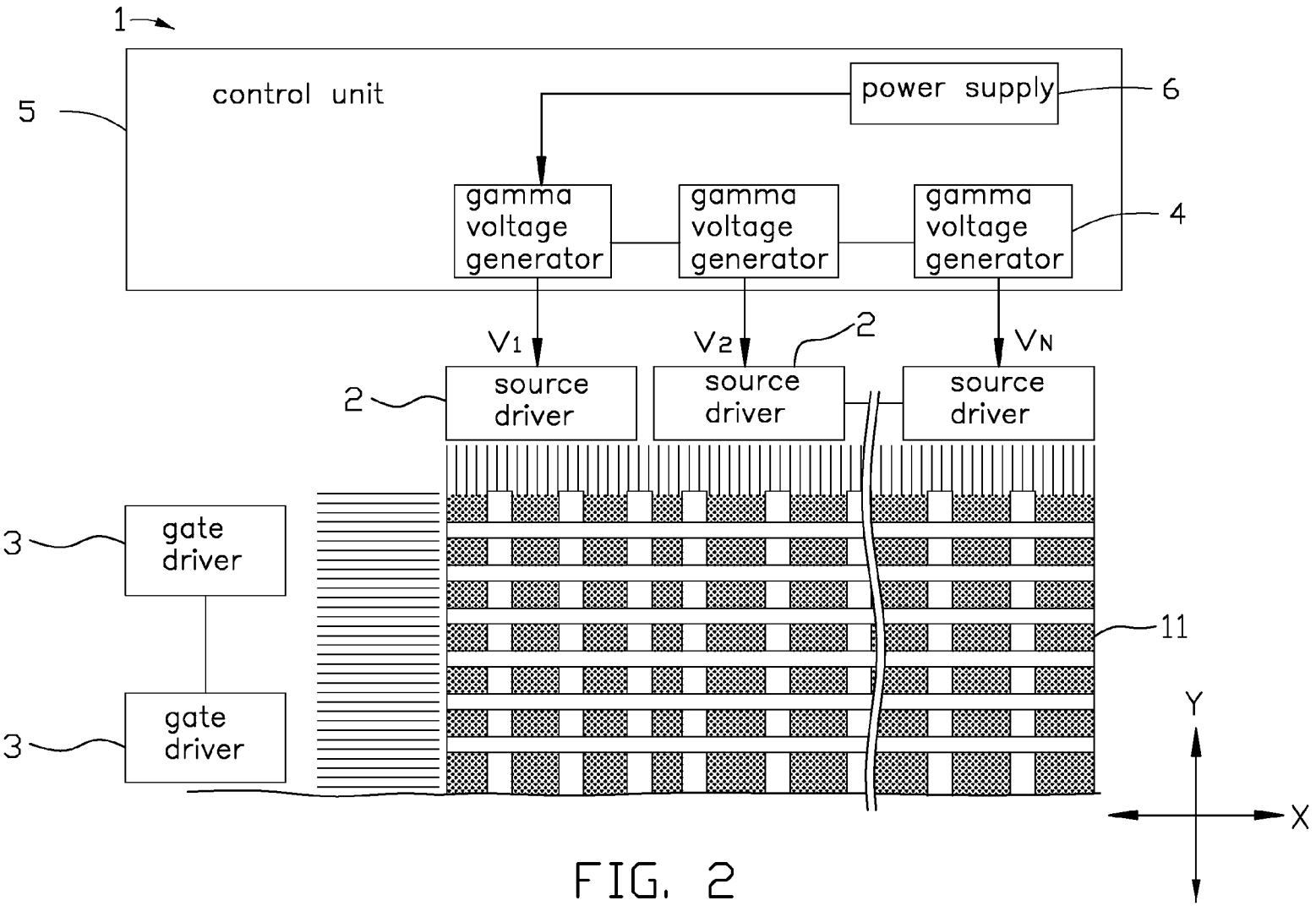
FIG. 2 is a block diagram of an LCD, according to a first embodiment of the present disclosure.

Referring to FIG. 2, an LCD 1 according to a first embodiment of the present disclosure, includes a plurality of source drivers 2 located along a first direction X, a plurality of gate drivers 3 located along a second direction Y orthogonal to the first direction X, a control unit 5, and a plurality of pixels are electrically connected to the source drivers 2 and the gate drivers 3. The control unit 5 includes a plurality of gamma voltage generators 4 and a power supply 6. The power supply 6 and the gamma voltage generators 4 are electronically connected in series.

Figure 3:
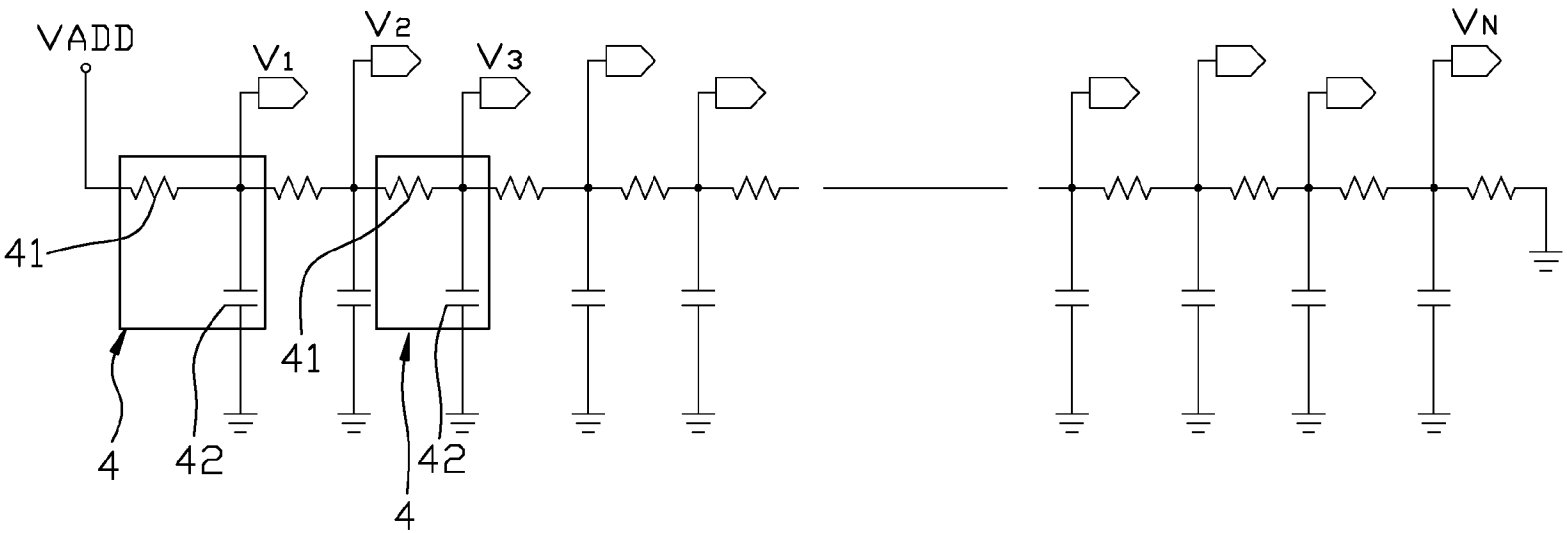
FIG. 3 is an abbreviated circuit diagram of gamma voltage generators shown in FIG. 2.
Figure 4:
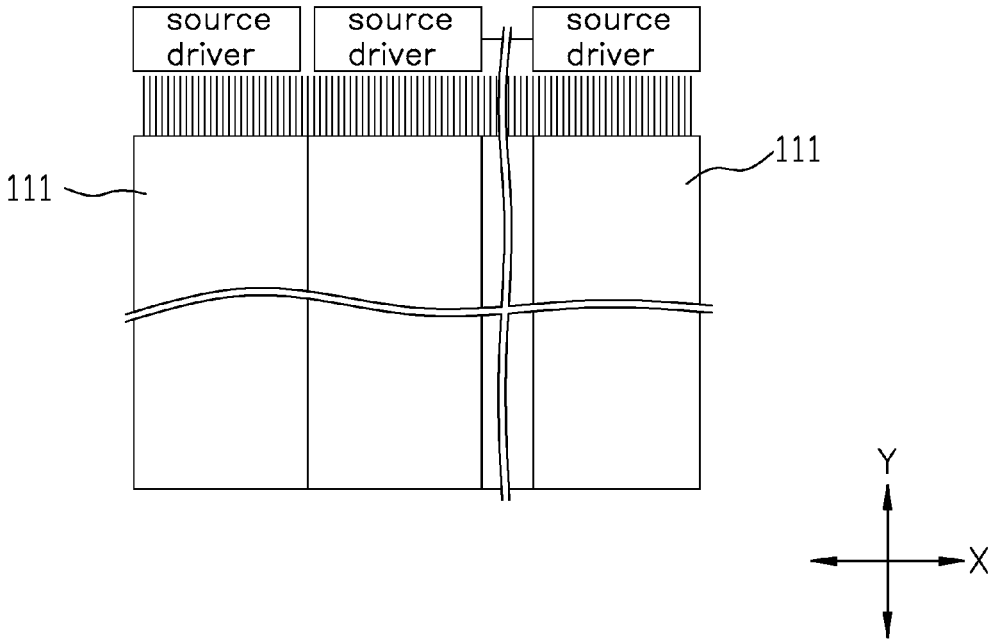
FIG. 4 is a block diagram of a display region of the LCD shown in FIG. 2.

Referring to FIG. 3, each gamma voltage generator 4 includes a resistor 41 and a capacitor 42, the resistor 41 and the capacitor 42 are electronically connected in series.

Referring to FIG. 1, FIG. 2, FIG. 3 and FIG. 4, the processes of the driving method of the LCD 1 according to the first embodiment of the present disclosure may include the following steps:

In step S1, a display region 11 of the LCD 1 is divided into a plurality of screen regions 111 along the first direction X, the screen regions 111 are in one-to-one correspondence with the source drivers 2.

In step S2, the power supply 6 provides an input voltage VADD to the gamma voltage generators 4, and the gamma voltage generators 4 generate regulated signals as $V_i$ (i=1, 2, 3 . . . N). The regulated signals $V_1$~$V_N$ are in one-to-one correspondence with the source drivers 2, and the regulated signals $V_1$~$V_N$ separately adjust the output voltage value of the corresponding source driver 2. The farther away from the gate drivers 3 along the first direction X, the regulated signal value increases, and the bigger the output voltage value becomes. The magnitude relationship of the regulated signals $V_1$~$V_N$ is $V_1<V_2<\ldots<V_N$. The regulated signals $V_1$~$V_N$ are adjusted by adjusting the resistor 41.

In step S3, the regulated signals $V_1$~$V_N$ are transmitted to the source drivers 2. The source driver 2 outputs the data signals according to the corresponding regulated signal $V_i$. Therefore, the source driver 2, which is farthest away from the gate drivers 3 along the first direction X outputs the maximum data signals.

According to the different regulated signals for the different screen regions, in the screen region of inadequate charging time, the source driver 2 outputs a bigger output voltage to increase the charging current, and the pixels in the screen region have potential to reach the standard voltage.

Figure 5:
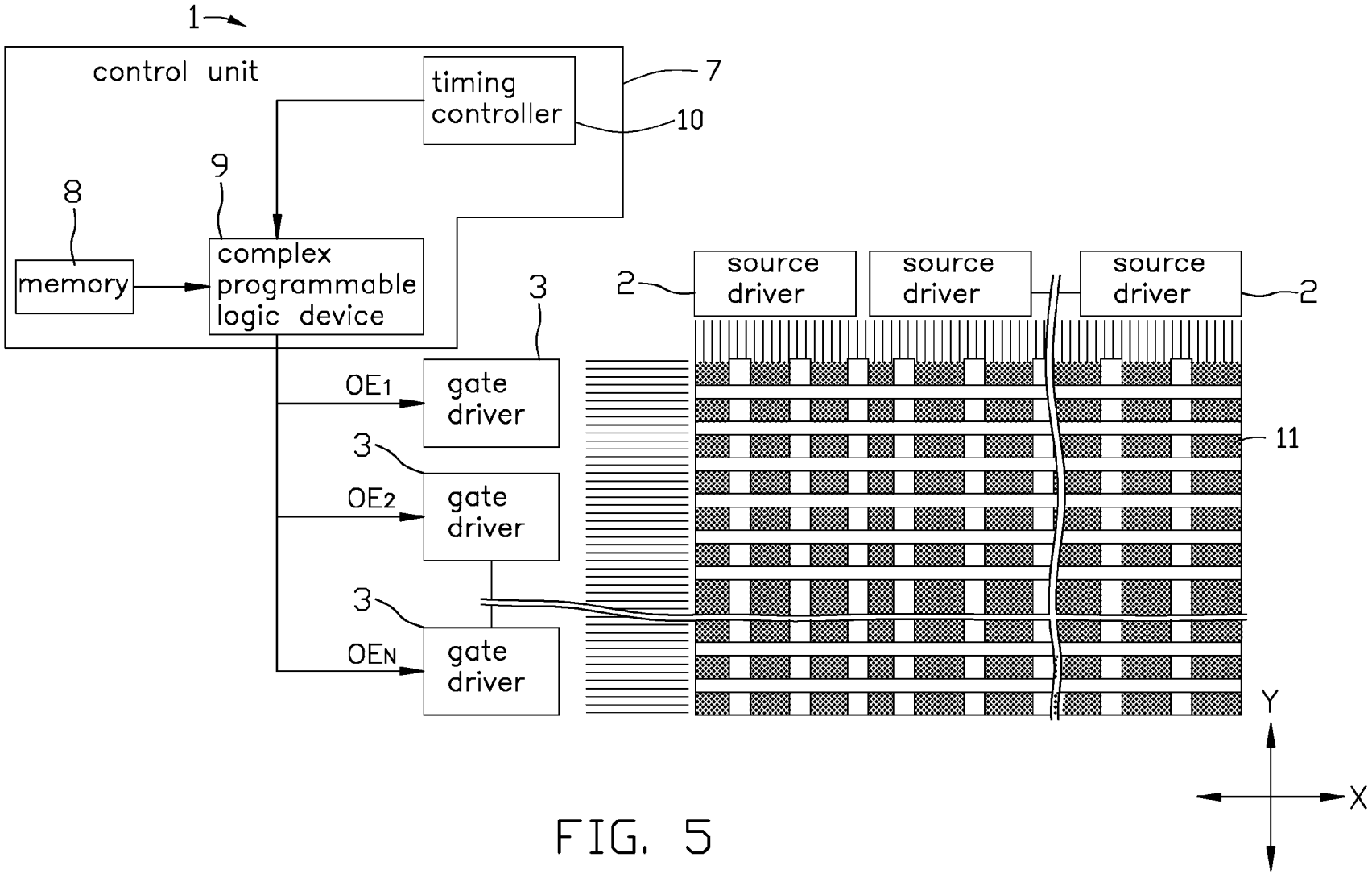
FIG. 5 is a block diagram of an LCD, according to a second embodiment of the present disclosure.
Figure 6:
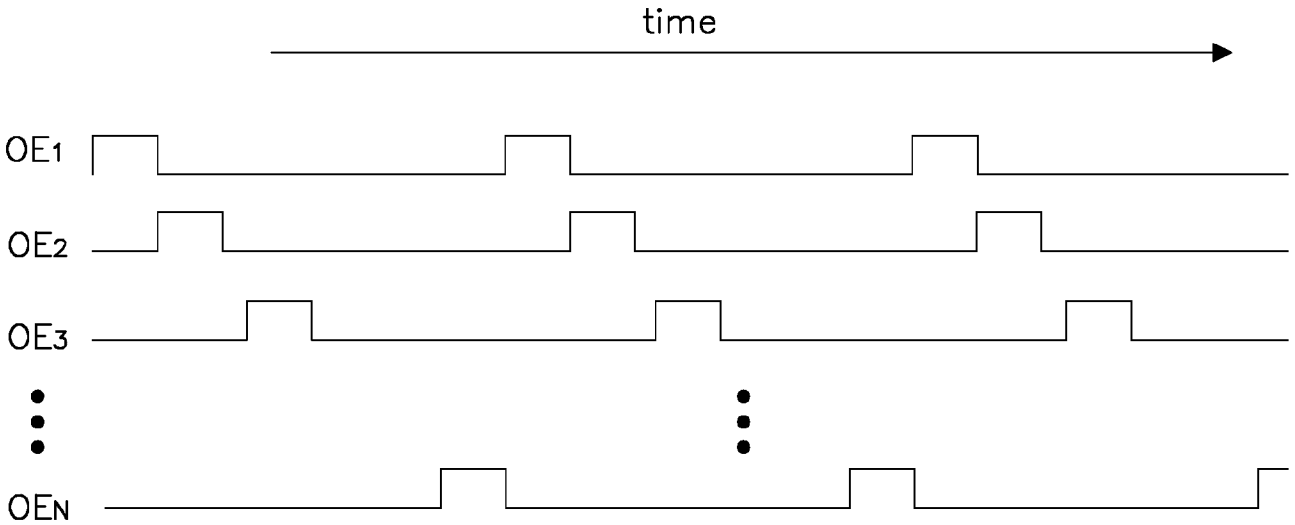
FIG. 6 is a timing chart of regulated signals shown in FIG. 5.
Figure 7:
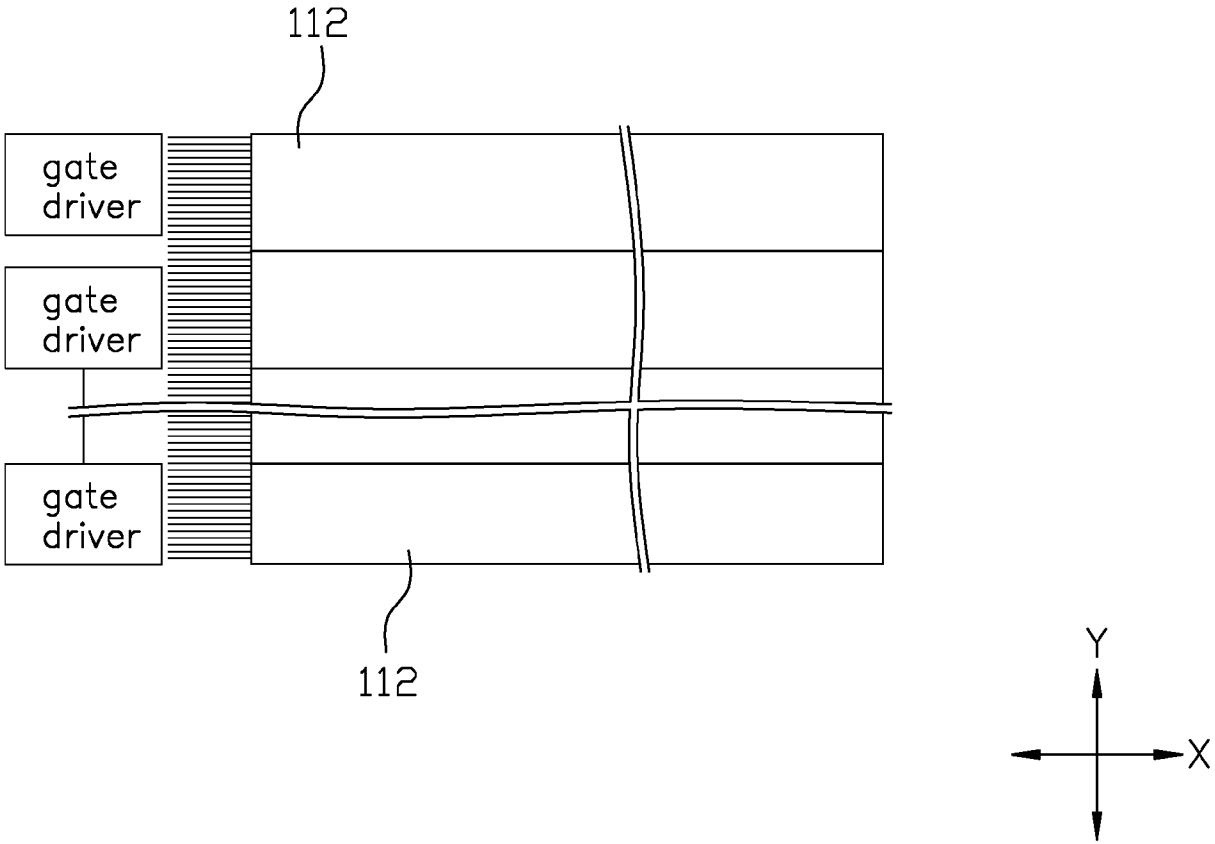
FIG. 7 is a block diagram of a display region of the LCD shown in FIG. 5.

Referring to FIG. 5, the LCD 1, according to a second embodiment of the present disclosure, includes a plurality of source drivers 2 located along the first direction X, a plurality of gate drivers 3, located along the second direction Y, a control unit 7, and a plurality of pixels electrically connecting to the source drivers 2 and the gate drivers 3. The control unit 7 includes a memory 8, a complex programmable logic device 9, and a timing controller 10. Both the memory 8 and the timing controller 10 are electronically connected to the complex programmable logic device 9. The memory 8 stores the display characteristics of the LCD 1.

Referring to FIG. 1, FIG. 5, FIG. 6 and FIG. 7, the processes of the driving method of the LCD 1, according to the second embodiment of the present disclosure may include the following steps:

In step S1, the display region 11 of the LCD 1 is divided into a plurality of screen regions 112 along the second direction Y, and the screen regions 112 are in one-to-one correspondence with the gate drivers 3.

In step S2, the timing controller 10 sends the timing signals to the complex programmable logic device 9. According to the display characteristics of the memory 8, the complex programmable logic device 9 outputs a plurality of regulated signals as $OE_i$ (i=1, 2, 3 . . . N). The regulated signals $OE_1$~$OE_N$ have different cycle shifts. The regulated signals $OE_1$~$OE_N$ are in one-to-one correspondence with the gate drivers 3, and the regulated signals $OE_1$~$OE_N$ separately adjust the operating time of the corresponding gate driver 3. When the voltage of the regulated signal $OE_i$ is at a high level, the corresponding gate driver 3 starts operating. The farther away from the source drivers 2 along the second direction Y, the more displacement of the cycle of the regulated signal $OE_i$ compared with the regulated signal $OE_1$. The regulated signals $OE_1$~$OE_N$, can be adjusted by the complex programmable logic device 9.

In step S3, the regulated signals $OE_1$~$OE_N$ are transmitted to the gate drivers 3. The gate driver 3 outputs the scan signals according to the corresponding regulated signal $OE_i$. Therefore, the gate driver 3, which is farthest away from the source drivers 2 along the second direction Y outputs the scan signals at an appropriate delay time.

Figure 8:
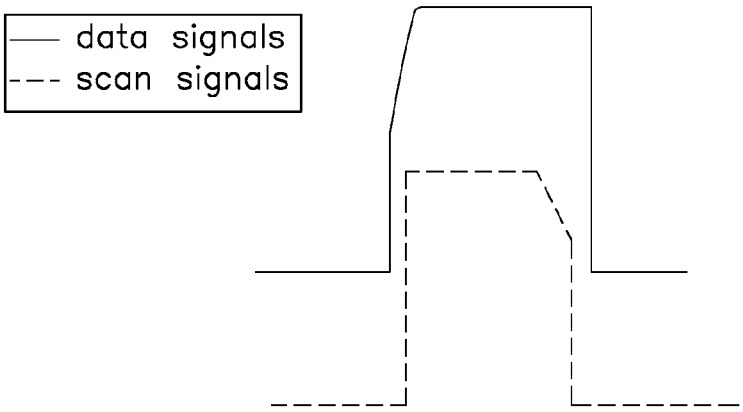
FIG. 8 is a waveform chart of data signals and scan signals according to the second embodiment of the present disclosure.
Figure 9:
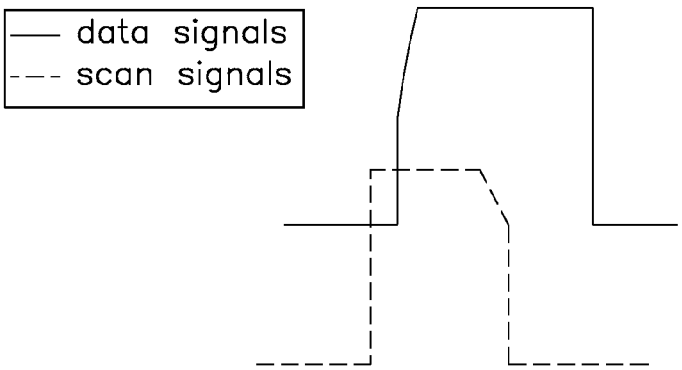
FIG. 9 (RELATED ART)
FIG. 9 is a waveform chart of data signals and scan signals in a first state according to a conventional LCD.
Figure 10:
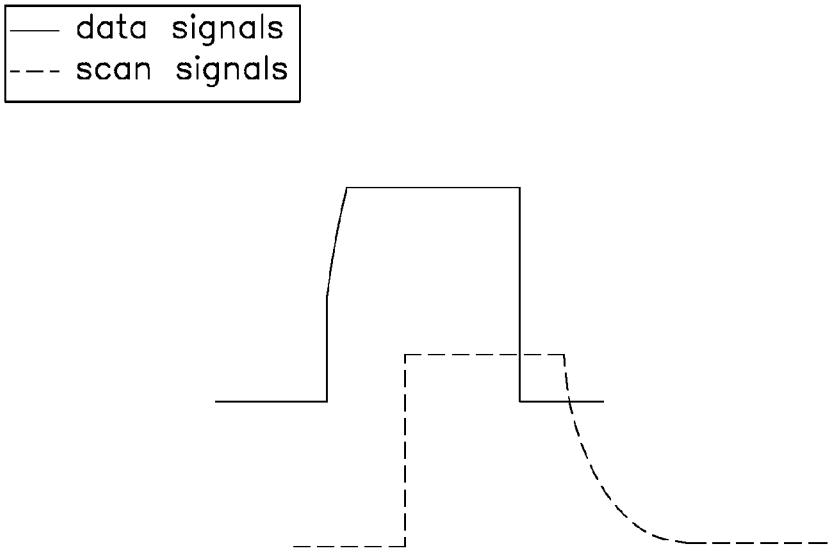
FIG. 10 (RELATED ART)
FIG. 10 is a waveform chart of the data signals and the scan signals in a second state according to the conventional LCD.

Referring to FIG. 8, a waveform chart of the data signals and the scan signals according to the second embodiment of the present disclosure is shown. There is no offset between the data signals and the scan signals.

According to the different regulated signals for the different screen regions, in the screen region of inadequate charging time, the operating time of the gate driver 3 is adjusted appropriately according to the display characteristics in the memory. Therefore, there is no offset between the data signals and the scan signals, and the pixels in the screen region have potential to reach the standard voltage.

In an alternative embodiment of the present disclosure, the gamma voltage generators 4 can be replaced by a single integrated circuit.

It is to be further understood that even though numerous characteristics and advantages of the present embodiments have been set forth in the foregoing description, together with details of structures and functions of various embodiments, the disclosure is illustrative only, and changes may be made in detail, especially in matters of shape, size, and arrangement of parts within the principles of the present disclosure to the full extent indicated by the broad general meaning of the terms in which the appended claims are expressed.

What is claimed is:

1. A driving method of a liquid crystal display, the liquid crystal display comprising a display region, a control unit, a plurality of source drivers located along a first direction and outputting data signals, and a plurality of gate drivers located along a second direction orthogonal to the first direction, the driving method comprising:

dividing the display region into a plurality of screen regions along the second direction, each screen region being in correspondence with one gate driver; and according to display characteristics of the screen regions, the control unit generating a plurality of regulated signals for the gate drivers;

wherein, the regulated signals are in one-to-one correspondence with the gate drivers and the gate drivers output scan signals according to the corresponding regulated signals, and the regulated signals separately adjust the operating time of the corresponding gate driver, such that offset between the data signals and the scan signals is reduced.

2. The driving method as claimed in claim 1, wherein the displacement of the cycle of the regulated signal increases the farther away from the source drivers along the second direction.

3. The driving method as claimed in claim 2, wherein the control unit includes a memory, a complex programmable logic device, and a timing controller, both the memory and the timing controller are electronically connected to the complex programmable logic device, and the memory stores the display characteristics of the LCD.

4. The driving method as claimed in claim 3, wherein the complex programmable logic device outputs a plurality of regulated signals which have different cycle shifts according to the display characteristics of the memory.

* * * * *